United States Patent [19]

Hudson

[11] Patent Number: 4,493,558

[45] Date of Patent: Jan. 15, 1985

[54] COMPENSATING VALVE SYSTEM FOR CONTROLLING ADJUSTABLE EMULSIFYING ORIFICE

[76] Inventor: Dannie B. Hudson, 15 Scott Dr., Morganville, N.J. 07751

[21] Appl. No.: 439,931

[22] Filed: Nov. 8, 1982

Related U.S. Application Data

[63] Continuation-in-part of Ser. No. 386,193, Jun. 7, 1982.

[51] Int. Cl.[3] ..... B01F 5/08

[52] U.S. Cl. ..... 366/341; 137/505.22

[58] Field of Search ..... 366/176, 336, 340, 341, 366/339; 138/45; 251/212 R; 137/505.22

[56] References Cited

U.S. PATENT DOCUMENTS

| | | | |
|---|---|---|---|
| 787,984 | 9/1903 | White . | |
| 1,769,612 | 7/1930 | Wettstein | 137/505.22 X |
| 1,918,891 | 7/1933 | Barrett | 137/505.22 X |
| 1,925,787 | 9/1933 | Brooks . | |
| 1,934,982 | 11/1933 | Jones | 137/505.22 X |
| 1,939,150 | 12/1933 | Terry | 137/505.22 X |
| 2,026,704 | 1/1936 | Petroe | 137/505.22 X |
| 2,196,251 | 4/1940 | Conrad | 137/505.22 X |
| 2,258,295 | 10/1941 | Merz . | |
| 2,321,336 | 6/1943 | Tondreau . | |
| 2,424,654 | 7/1947 | Gamble . | |
| 2,493,449 | 1/1950 | Fitch . | |
| 2,552,195 | 5/1951 | Lopata . | |
| 2,573,680 | 11/1951 | Arnold | 137/505.22 X |
| 2,628,204 | 2/1953 | Gray . | |
| 2,658,521 | 11/1953 | Lyon | 137/505.22 X |
| 2,687,144 | 8/1954 | Rafferty | 137/505.22 X |
| 2,968,919 | 1/1961 | Hughes et al. . | |
| 3,106,225 | 10/1963 | Spurling . | |
| 3,370,610 | 2/1968 | Miner | 251/212 X |
| 3,409,050 | 11/1968 | Weese . | |
| 3,473,781 | 10/1969 | Abbott et al. . | |
| 3,585,813 | 6/1971 | Hansen . | |
| 3,593,959 | 7/1971 | Greene . | |
| 3,865,132 | 2/1975 | Wiegand . | |
| 3,958,592 | 5/1976 | Wells et al. . | |
| 4,081,863 | 3/1978 | Rees | 366/176 |
| 4,085,463 | 4/1978 | Wilson . | |
| 4,087,986 | 5/1978 | Grahl . | |
| 4,127,332 | 11/1978 | Thiruvengadam et al. | 366/131 |
| 4,191,216 | 3/1980 | Connolly . | |
| 4,213,711 | 7/1980 | Bailey . | |
| 4,253,487 | 3/1981 | Worley et al. | 251/212 X |

*Primary Examiner*—Philip R. Coe
*Assistant Examiner*—Frankie L. Stinson
*Attorney, Agent, or Firm*—Lerner, David, Littenberg, Krumholz & Mentlik

[57] ABSTRACT

A fuel system is described for homogenizing a liquid fuel component and a fresh water component by an adjustable emulsifying orifice. The downstream pressure of the homogenized fuel and water components at the suction side of a feed pump is monitored and controlled by a compensating valve which continuously and automatically adjusts the orifice size within the adjustable emulsifying orifice. The compensating valve is arranged in fluid communication with the suction side of the pump to be operative in response to changes in the pressure. The compensating valve is of the diaphragm type having an underlying piston provided with piston rings which prevent fluid communication between the suction side of the pump and its internal connecting assembly in the event of rupture of the diaphragm.

18 Claims, 2 Drawing Figures

COMPENSATING VALVE SYSTEM FOR CONTROLLING ADJUSTABLE EMULSIFYING ORIFICE

BACKGROUND OF THE INVENTION

This application is a continuation-in-part of my copending application Ser. No. 386,193, filed on June 7, 1982.

The present invention relates in general to a system for homogenizing a liquid fuel component and an insoluble fresh water component by an adjustable emulsifying orifice and, more particularly, to such an adjustable emulsifying orifice including a compensating valve system for automatically controlling the downstream pressure of the homogenized liquid fuel and insoluble fresh water components by adjusting the size of the orifice in response to changes of the downstream pressure. The adjustable emulsifying orifice operates under the principle of cavitating flow wherein the substantially insoluble component may be either a liquid or a finely divided solid.

In accordance with U.S. Pat. No. 4,127,332, there is disclosed a homogenization apparatus which provides an emulsion or colloidal suspension having an extremely long separation half-life by the use of cavitating flow. The prior art homogenization apparatus is constructed of a generally cylindrical conduit including an orifice plate assembly extending transversely thereacross and having an orifice provided therein. The orifice is described as embodying various designs such as circular blunt or sharp edged, square sharp edged and, a pair of substantially semicircular annular segments. The homogenization process is effected by passing a multicomponent stream, including a liquid component and at least one insoluble component, into a cavitating free turbulent velocity shear layer created by the orifice through which the stream flows with a high velocity. The cavitating free turbulent shear layer provides a flow regime in which vapor bubbles form, expand, contract and ultimately collapse. By subsequently exposing the free turbulent shear layer to a sufficient high downstream pressure, the bubbles collapse violently and cause extremely high pressure shocks which cause intermittent intermixing of the multicomponent stream. As result, a homogenized effluent of the liquid component and the insoluble component is generated which has a substantially improved separation half-life.

It is generally known that the effective intermixing of a multicomponent stream such as fuel oil and fresh water is dependent upon a number of factors, for example, upstream pressure, downstream or pump suction pressure, conduit diameter, orifice diameter, etc. In a fuel system which is capable of homogenizing blended fuels and/or fuel and fresh water, one factor which is considered to be significant where such systems are used in boilers in marine application, as well as in industry or in power utility applications, is the downstream or pump suction pressure. This pressure is controlled directly by the orifice diameter, which factor is often the most difficult to control effectively over the continued use of the homogenization apparatus, in particular, during non-steady state periods of operation. Upon heating of the orifice plate assembly by the fuel, the resulting expansion causes variation in the orifice diameter thereby adversely effecting the downstream and pump suction pressure, as well as the homogenization process.

In addition, changes in temperature of the multicomponent stream, as well as fluctuations in the upstream pressure will adversely alter the downstream or pump suction pressure causing less than optimum performance of the fuel system. For example, it has been found that a 1° F. change in temperature of the fuel will cause a 3 psig change in the downstream or pump suction pressure. Also it has been found that a 1 psig change in the upstream pressure will cause a 0.6 psig change in the downstream or pump suction pressure. Under normal operation of such a fuel system at a pump suction pressure of 25 psig, it is required that this pressure be controlled within ±2 psig. Further, erosion of the orifice plate assembly at the orifice due to chemical or mechanical action caused by the insoluble particles within the multicomponent stream, causes the orifice diameter to increase during the homogenization process also resulting in a change in the downstream or pump suction pressure and loss of effectiveness of the intermixing of the multicomponent stream. Still further, it is generally required that the orifice diameter be determined for each different homogenization process, which determination is generally extensive in labor, in addition, to requiring system shutdown during installation of a different orifice plate assembly.

Thus, it can be appreciated that there is an unsolved need for a compensating valve system for controlling an adjustable emulsifying orifice adapted for use in a homogenization apparatus of a fuel system which provides for the effective intermixing of a multicomponent stream over a variety of operating conditions in an economical and effective manner by automatically controlling the downstream or pump suction pressure by adjusting the orifice size in response to changes of the downstream or pump suction pressure, as effected by the foregoing.

SUMMARY OF THE INVENTION

It is broadly an object of the present invention to provide a compensating valve system for controlling an adjustable emulsifying orifice for use in a fuel system which overcomes or avoids one or more of the foregoing disadvantages resulting from the use of the abovementioned prior art orifice plate assembly and, which fulfills the requirements of same for use in a fuel system for the intermixing of a multicomponent fuel stream. Specifically, it is within the contemplation of one aspect of the present invention to provide a compensation valve system for controlling an adjustable emulsifying orifice adapted to have replaceable orifice elements and which are continuously and automatically adjusted over a range of operating conditions for controlling the downstream or pump suction pressure, as well as accomodating the various process parameters encountered during the use of a fuel system in the manner previously described.

A further object of the present invention is to provide a compensating valve system for controlling an adjustable emulsifying orifice adapted for use in a homogenization apparatus of a fuel system for homogenizing a liquid and a substantially insoluble component by generating a cavitating flow regime in a turbulent velocity shear layer.

A still further object of the present invention is to provide a compensating valve system for controlling an adjustable emulsifying orifice adapted for use in a homogenization apparatus of a fuel system for homogenizing a multicomponent fuel stream to produce an intermixing of a dispersed fresh water component and a continuous fuel component.

A still further object of the present invention is to provide a compensating valve system for controlling an adjustable emulsifying orifice adapted for use in a fuel system for automatically controlling the downstream or pump suction pressure over a variety of operating conditions by adjusting the orifice size in response to changes of the downstream or pump suction pressure.

A yet still further object of the present invention is to provide a compensating valve system for controlling an adjustable emulsifying orifice adapted for providing an automatically controlled orifice in a fuel system for boilers and the like.

The above, and many other objects of the present invention, are satisfied by a compensating valve system for controlling an adjustable emulsifying orifice in accordance with one embodiment of the present invention adapted for homogenizing a liquid component and an insoluble component comprising orifice means for providing an adjustable orifice within a stream of the liquid component and adjusting means in operative association with the orifice means for controlling the downstream pressure of the homogenized liquid and insoluble components by adjusting the size of the orifice in response to changes of the downstream pressure.

In accordance with the above embodiment, the adjusting means comprises a casing having a bore therein, a diaphragm arranged with the casing and dividing the bore into a first and second chamber, the first chamber being in communication with the downstream pressure for causing displacement of the diaphragm, a pistion arranged within the second chamber for movement in response to the displacement of the diaphragm, and connecting means for connecting the piston to the orifice means for adjusting the size of the orifice in response to changes of the downstream pressure.

Further, in accordance with the above embodiment, the piston includes sealing means for sealing the piston in sliding engagement within the second chamber so as to prevent fluid communications between the first chamber and the connecting means.

In accordance with another embodiment of the present invention there is provided a system for homogenizing a liquid fuel component and an insoluble water component comprising a body positioned within a stream of the liquid fuel component for restricting the flow thereof, the body having an opening and a pair of radially extending passageways in communication with the opening, a pair of elements movably positioned in opposed relationship within the opening for providing an orifice therebetween through which the stream of the liquid fuel component flows, a rod positioned within one of the radially extending passageways and having one of the elements secured to one end thereof within the opening for controlling the movement of the one element within the opening, and adjusting means connected to the other of the elements for automatically controlling the downstream pressure of the homogenized liquid fuel and insoluble water components, the adjusting means comprises a casing having a bore therein, a diaphragm arranged within the casing and dividing the bore into a first and second chamber, the first chamber being in communication with the downstream pressure for causing displacement of the diaphragm, a piston arranged within the second chamber for movement in response to the displacement of the diaphragm, connecting means for connecting the piston to the other of the elements for adjusting the size of the orifice in response to changes of the downstream pressure by controlling the relative position between the elements within the opening, and sealing means for sealing the piston in sliding engagement within the second chamber so as to prevent fluid communication between the first chamber and the connecting means.

In accordance with the last mentioned embodiment, the sealing means includes a plurality of rings arranged circumferentially around the piston.

Further in accordance with the last mentioned embodiment, the sealing means further includes an O-ring arranged within the lower half of the casing on a surface thereof opposite a sealing surface of the piston.

BRIEF DESCRIPTION OF THE DRAWINGS

The above description, as well as further objects, features and advantages of the present invention will be more fully understood by reference to the following detailed description of a presently preferred but nonetheless illustrative compensating valve system for controlling an adjustable emulsifying orifice in accordance with the present invention when taken in conjuction with the accompanying drawings, wherein.

DETAILED DESCRIPTION OF THE INVENTION

Figure 1:
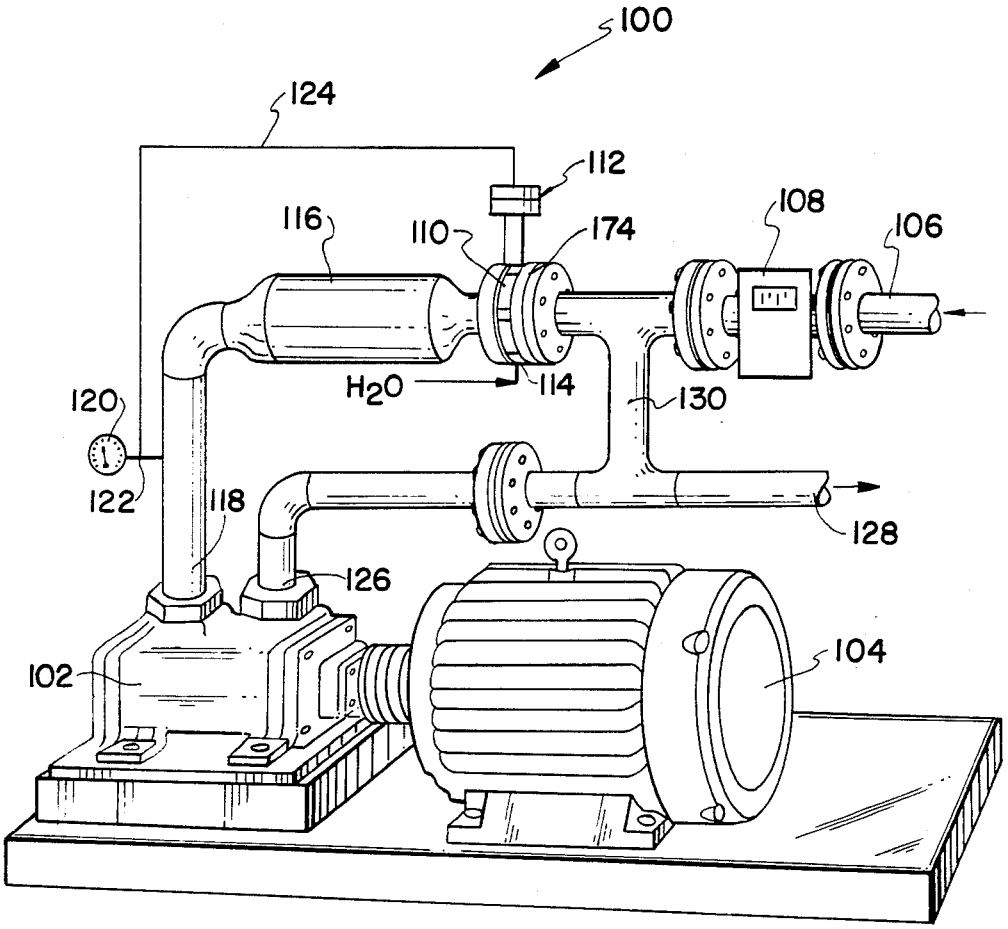
FIG. 1 is a perspective view of a multicomponent fuel system for use in feeding a boiler and having a compensating valve system for controlling an adjustable emulsifying orifice in accordance with the present invention; and, FIG. 2 is a front elevation in partial cross section showing the compensating valve system for controlling an adjustable emulsifying orifice in accordance with the present invention, such compensating valve including a flexible diaphragm responsive to the downstream or pump suction pressure for causing movement of an underlying piston having sealing rings thereabout for adjusting the orifice size in response to changes in the downstream or pump suction pressure.

Referring generally to the drawings wherein like reference numerals are applied to like elements, there is shown in FIG. 1 a fuel system generally designated by reference element 100. The fuel system is constructed from a screw pump 102 driven by an electric motor 104. Fuel oil from a source thereof is supplied to an inlet pipe 106 at a pressure generally about 300 psig and thence through a fuel flow meter 108 with remote or local readout. The metered fuel passes through an adjustable emulsifying orifice 110 controlled by a compensating valve 112 as both constructed in accordance with the present invention. The fuel oil is homogenized with a quanitity of fresh water entering through port 114 by cavitating flow within the emulsion chamber 116. The homogenized fuel/water mixture enters the suction side 118 of the pump 102 which is generally controlled at a pressure of about 20–40 psig and which is provided with a pressure gauge 120 having a tap 122 to provide fluid communication via pipe 124 with the compensating valve 112. The discharge side 126 of the pump 102 is connected to an outlet pipe 128 through which the homogenized fuel/water mixture flows at a pressure generally about 300 psig. The outlet pipe 128 and inlet pipe 106 are connected by a homogenized fuel/water recirculation loop 130 to recycle approximately 25% of the pump's 102 output. The recirculation loop 130 eliminates the need for a relief valve in the fuel system 100.

Figure 2:
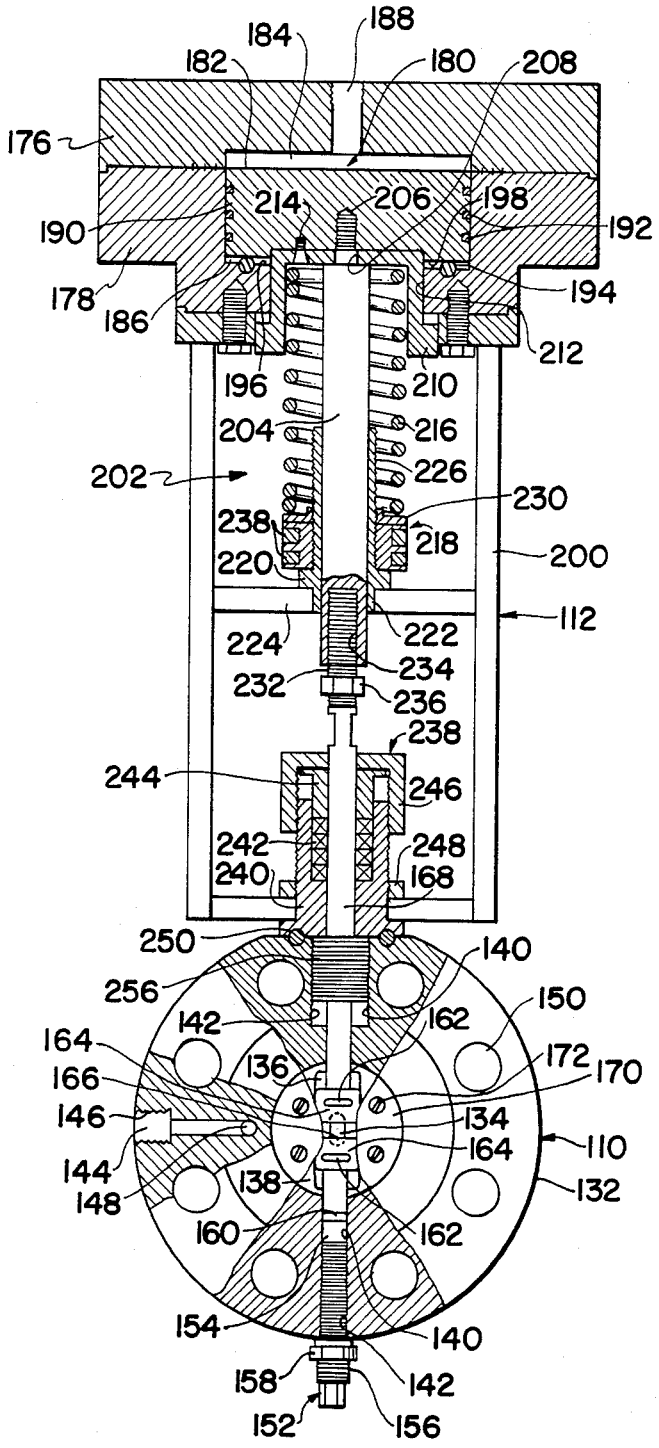

Referring now to FIG. 2, the construction and operation of the adjustable emulsifying orifice 110 and compensating valve 112 in accordance with the present invention will now be described. The construction and operation of the adjustable emulsifying orifice 110 is as described and illustrated in the above-identified application Ser. No. 386,193 and accordingly will not be described in detail. Briefly, the adjustable emulsifying orifice 110 is constructed of a generally planar body 132 of circular shape having a central opening formed of a bottom slotted opening 134, a rectangular central opening 136 and a top disk shaped opening 138. The body 132 is further constructed to include a pair of opposed radially extending passageways 140 communicating between the rectangular central opening 136 and the periphery of the body. The peripheral mouth of the passageways 140 are provided with internal threads 142 extending partially therein. A third radially extending passageway 144 is provided within the body 132 having a threaded inlet 146 and an outlet 148 on the downstream side of the adjustable emulsifying orifice 110 for supplying fresh water to be emulsified with the fuel passing through the slotted opening 134. Located around the circumference of the body 132 are a plurality of installation holes 150.

A manual control assembly 152 is constructed from a longitudinally extending rod 154 having a threaded portion 156 including a nut 158, a circumferential groove for retaining an O-ring 160 and a T-shaped projection 162. An orifice element 164 having a generally planar face 166 is adapted to be removably secured to the projection 162 of the rod 154 by sliding engagement within a T-shaped slot provided therein. In generally similar construction, a valve stem 168 of the compensating valve 112 is provided at one end with a T-shaped projection 162 for attaching an orifice element 164. The manual control assembly 152 and valve stem 168 are inserted within a passageway 140 until its projection 162 enters the rectangular central opening 136 of the body 132. A pair of orifice defining elements 164 are positioned within the rectangular central opening 136 and are removably secured to the projections 162 of the rod 154 and valve stem 168 via the T-shaped slot provided therein. A cover 170 is adapted to be received within the disk shaped opening 138 overlying the orifice elements 164 and having a slotted opening (not shown) in alignment with the slotted opening 134 within the body 132. The cover 170 is secured within the disk shaped opening 138 by a plurality of bolts 172.

The assembled adjustable emulsifying orifice 110 is secured for use between a pair of flanges 174 as illustrated in FIG. 1 using a pair of gaskets and a plurality of circumferentially arranged bolts within the holes 150 of the body 132. Initially, the size of the orifice through which a stream of liquid may flow from the inlet pipe 106 to the suction side 118 of the pump 102 is controlled by adjusting the spaced relationship between the orifice elements 164 within the rectangular central opening 136 via the manual control assembly 152. That is, by turning the rod 154 within the passageway 140, the faces of the orifice elements 164 are brought into closer or further spaced relationship so as to cause adjustment in the size of the orifice provided therebetween. During such adjustment, the O-ring 160 provides a liquid seal between the rod 54 and the passageway 140. Although the faces of the orifice elements 164 have been described and illustrated as being transversely planar, it is readily apparent that other shapes of this face may be provided, for example, concave.

The specific application of the adjustable emulsifying orifice 110 in effecting the homogenization of a liquid component and an insoluble component using cavitating flow is in general accordance with the previously noted U.S. Pat. No. 4,127,332 and accordingly will be described in detail. For example, suitable liquid components are water, hydrocarbon fuels, and the like; while suitable insoluble components are liquids such as water, hydrocarbon fuels, particulate solids such as pulverized coal, and the like. Where the liquid component is water and the substantially insoluble component is hydrocarbon fuel, or in the alternative, where water is the insoluble component and hydrocarbon fuel is the liquid component, the homogenized effluent is a fluid emulsion which may subsequently be used as a fuel such as for the burner of a boiler. With such a boiler, the fuel might consist of a fuel/water emulsion, a coal/oil colloidal suspension or an oil/oil emulsion. However, it is noted that the insoluble component, i.e., water, may be introduced into the liquid component either at the upstream or downstream side of the adjustable emulsifying orifice 110.

Referring again to FIG. 2, there will now be described the construction and operation of the compensating valve 112 in further accordance with the present invention. The compensating valve 112 is constructed to include an upper casing 176 and an opposed lower casing 178 having a bore 180 therebetween. A neoprene diaphragm 182 of 0.0325 inches thick having a cloth central layer is arranged within the bore 180 and having its peripheral edge secured between the upper and lower casings 176, 178 to divide the bore into a first chamber 184 and a second chamber 186. The upper casing 176 includes a port 188 providing for fluid communication between the first chamber 184 and the downstream pressure of the homogenized liquid and insoluble components via pipe 124 being connected to tap 22 at the suction side 118 of the pump 102, as best shown in FIG. 1. A piston 190 is movably positioned within the second chamber 186 of the lower casing 178 having its upper surface adjacent the diaphragm 182 thereby causing downward movement of the piston in response to displacement of the diaphragm. A plurality of piston rings 192 are provided around the circumference of the piston 190 for sealing the piston in sliding engagement within the second chamber 186 of the lower casing 178. In addition, an O-ring 194 is arranged within the lower casing 178 on surface 196 opposite the bottom surface 198 of the piston 190. The function of the piston rings 192 and O-ring 194 will be described hereinafter.

A housing 200 is provided between the upper and lower casings 176, 178 and the adjustable emulsifying orifice 110 for housing the connecting assembly generally designated by element 202. The connecting assembly 202 is provided for connecting the piston 190 to an orifice element 164 within the adjustable emulsifying orifice 110. The connecting assembly 202 is generally constructed from a piston rod 204 having a threaded end 206 connected to the piston 190 through an opening 208 provided within a spring retainer/piston stop 210. The spring retainer/piston stop 210 is slidably received within an opening 212 provided within the lower casing 178 and is attached to the piston 190 by screw 214 for movement therewith. The piston 190 is adjustably biased against the lower side of the diaphragm 182 by a bias spring 216 positioned between the spring retainer/-piston stop 210 and a spring biasing adjustment assembly generally designated by element 218.

The spring biasing adjustment assembly 218 is constructed of an adjusting nut lead screw 220 having an opening therethrough to receive in sliding engagement the piston rod 204 and having its lower end 222 secured to a cross brace 224 and its upper end provided with a plurality of external threads 226. A pair of adjusting locking nuts 228 are threadably engaged about the threaded portion of the adjusting nut lead screw 220 for supporting a lower spring retainer 230 such that the biasing force of the spring 216 may be increased or decreased by altering the relative position of the lower spring retainer by means of the adjusting locking nuts.

The piston rod 204 is connected to the valve stem 168 by means of a threaded portion 232 of the valve stem being received within an internally threaded portion 234 of the piston rod. A lock nut 236 is provided about the threaded portion 232 of the valve stem 68 for fixed adjustment of the connection between the piston rod and valve stem. The valve stem 168 is slidingly received through a packing assembly generally designated by element 238. The packing assembly 238 is constructed from a packing gland 240 having an opening therethrough for receiving the valve stem 168 and a plurality of packing 242. The packing is compressed within the opening of the packing gland 240 by means of a packing bushing 244 and a packing nut 246 overlying the packing bushing and having internal threads for engaging the threads of the packing gland 240. The packing gland 240 is secured to the housing 200 by a lock nut 248. An O-ring 250 is provided on the packing gland 240 to provide a seal between the packing gland and the body 132 of the adjustable emulsifying orifice 10. As illustrated, the valve stem 168 extends into the passageway 140 of the adjustable emulsifying orifice 110 through an externally threaded bushing 252 provided therein. As previously described, the end of the valve stem 168 is provided with a T-shaped projection 162 for securing an orifice element 164 thereto.

In accordance with the present invention, the adjustable emulsifying orifice 110 having the compensating valve 112 operatively connected thereto is secured between the pair of flanges 174 of the fuel system 100 as illustrated in FIG. 1. The first chamber 184 provided within the upper casing 176 of the compensating valve 112 is fluidly connected to the low pressure downstream side of the adjustable emulsifying orifice 110 via the connection of pipe 124 to the tap 122 at the suction side 118 of the pump 102. Fuel oil is continuously supplied through the inlet pipe 106 at a pressure of about 300 psig. The orifice elements 164 are arranged in opposed relationship within the rectangular central opening 136 to provide an orifice through which the fuel oil flows. The orifice is adjustable over the range of about 0.001 to 0.125 inches. The adjustable emulsifying orifice 110 is adapted for controlling the downstream pressure at the suction side 118 of the pump 102 in the range of approximately 20–30 psig. Preferably, the downstream or pump suction pressure is controlled at approximately 25 psig±2 psig. Fresh water, for example about 8%, is introduced in the manner previously described either on the downstream side of the adjustable emulsifying orifice 110 through outlet 148 or within the upstream side of the adjustable emulsifying orifice to effect its homogenization with the fuel oil within the emulsion chamber 116.

The downstream pressure of the homogenized fuel oil and fresh water components at the suction side 118 of the pump 102 may be controlled easily, for example within ±2 psig, by adjusting the size of the orifice provided between the orifice elements 164. In this regard, the compensating valve 112 is operative to alter the spaced relationship between the orifice elements 164 automatically in response to changes in the downstream or pump suction pressure, in fact, it is possible with the present invention to adjust this spaced relationship in the narrow range of from 0.001 to 0.002 inches, as well as over the entire broad range of operability of the adjustable emulsifying orifice 110.

Initially, the spaced relationship between the orifice elements 164 is adjusted by the manual adjustment of the manual control assembly 152 and by adjusting the extent of the engagement of the threaded portion 232 of the valve stem 168 within the threaded portion 234 of the piston rod 204 and secured thereat by the locking nut 236. The piston 190 is biased by spring 216 against the diaphragm 182 to equalize the downstream or pump section pressure of the homogenized fuel oil and fresh water components within the first chamber 184 of the upper casing 176. Thus, when the downstream pressure at the suction side 118 of the pump 102 is at its proper or normal magnitude, no movement of the piston 190 will occur. However, should the downstream pressure either increase or decrease, such increase or decrease will cause either upward or downward deflection of the diaphragm 182 thereby causing upward or downward movement of the piston 190 and accordingly the respective opening or closing of the orifice elements 164 within the adjustable emulsifying orifice 110. In this manner, the present invention provides a system for automatically controlling the downstream pressure of the homogenized fuel oil and fresh water components by adjusting the size of the orifice in response to changes in the downstream or pump suction pressure by controlling the relative position between the orifice elements 164.

Further in accordance with another aspect of the present invention, it is desirable to prevent contamination of the connecting assembly 202 with fuel oil in the event the diaphragm 182 should rupture. In this regard, the compensating vale 112 of the present invention prevents fluid communication between the fuel oil and the connecting assembly 202. Specifically, the piston rings 192 positioned around the piston 190 prevent any fuel oil from passing through the second chamber 186 in the event the diaphragm 182 should rupture. In addition, should the diaphragm rupture 182, the pressure of the fuel oil within the bore 180 will cause the piston 190 to be urged downward against the O-ring 194 further providing a seal to prevent the fuel oil from communicating with the connecting assembly 202. As a result, in the event of a rupture of the diaphragm 182, the fuel oil will be prevented from leaking out of the fuel system 100 thereby avoiding spillage and contamination of the fuel oil, as well as eliminating the need for disassembling the connecting assembly 202 for cleaning or repair. In the event the diaphragm 182 is ruptured, the upper and lower casings 176, 178 may be conveniently separated and a new diaphragm 182 provided therebetween without having to disassemble or clean the connecting assembly 202.

In accordance with another aspect of the present invention, should the orifice elements 164 erode severely or become damaged during use, these elements may be easily and quickly replaced upon removing the cover 170. As further noted, the minor erosion of the orifice elements 164 may be automatically compensated for by the compensation valve 112. In the preferred embodiment, the orifice elements 164 are constructed of nitriding steel No. 135, modified. The adjustable emulsifying orifice 110 is readily adaptable to various process conditions in which various orifice sizes are required. Thus, it can be appreciated that the present invention has superior advantages to the fixed diameter orifice system of the prior art and overcomes the above noted problems associated with such prior art.

In accordance with the present invention, there has been described an apparatus for homogenizing a liquid component and an insoluble component comprising, a body positioned within the flow of a stream of the liquid component for impeding the flow thereof and having an opening therein, a pair of orifice means movably positioned within the stream that the liquid component flows, and adjusting means in operative association with one of the orifice means for controlling the downstream pressure of the homogenized liquid and insoluble components by controlling the relative position of the orifice means with one another within the opening in response to changes of the downstream pressure.

Although the invention herein has been described with reference to particular embodiments, it is to be understood that these embodiments are merely illustrative of the principals and application of the present invention. It is to be understood that numerous modifications may be made in the illustrative embodiments and that other arrangements may be devised without parting from the spirit and scope of the present invention as defined by the appended claims.

What is claimed is:

1. An apparatus for homogenizing a pair of fluid components within a conduit having upstream and downstream sides, at least one of said components comprising a hydrocarbon fuel, said apparatus comprising orifice means arranged within said conduit between said upstream sides for providing an adjustable orifice within a stream of said hydrocarbon fuel, said orifice means comprising a pair of spaced-apart elements defining an opening therebetween for homogenizing said pair of fluid components, and adjusting means in operative association with at least one of said pair of elements for continuously varying the size of said opening for controlling the pressure of the homogenized pair of fluid components within the downstream side of said conduit in response to downstream pressure changes thereof.

2. The apparatus as set forth in claim 1 wherein said adjusting means comprises a casing having a bore therein, a diaphragm arranged within said casing and dividing said bore into a first and second chamber, said first chamber being in communication with said downstream pressure for causing displacement of said diaphragm, a piston arranged within said second chamber for movement in response to the displacement of said diaphragm, and connecting means for connecting said piston to said orifice means for adjusting the size of said orifice in response to changes of said downstream pressure.

3. The apparatus as set forth in claim 2 wherein said piston includes sealing means for sealing said piston in sliding engagement within said second chamber so as to prevent fluid communication between said first chamber and said connecting means.

4. The apparatus as set forth in claim 2 wherein said connecting means includes biasing means for biasing said piston against said diaphragm.

5. An apparatus for homogenizing a pair of fluid components within a conduit having upstream and downstream sides, at least one of said components comprising a hydrocarbon fuel, said apparatus comprising, a body positioned within the flow of a stream of said hydrocarbon fuel between said upstream and downstream sides for impeding the flow thereof and having an opening therein, a pair of spaced-apart orifice means movably positioned within said opening for providing an orifice through which said stream of said hydrocarbon fuel flows for homogenizing said pair of fluid components, and adjusting means in operative association with one of said orifice means for continuously varying the relative spaced-apart positions of said orifice means with one another within said opening for controlling the pressure of the homogenized pair of fluid components within the downstream side of said conduit in response to downstream pressure changes thereof.

6. The apparatus as set forth in claim 5 wherein said adjusting means comprises a casing having a bore therein, a diaphragm arranged within said casing and dividing said bore into a first and second chamber, said first chamber being in communication with said downstream pressure for causing displacement of said diaphragm, a piston arranged within said second chamber for movement in response to the displacement of said diaphragm, and connecting means for connecting said piston to at least one of said orifice means for adjusting the size of said orifice in response to changes of said downstream pressure.

7. The apparatus as set forth in claim 6 wherein said piston includes sealing means for sealing said piston in sliding engagement within said second chamber so as to prevent fluid communication between said first chamber and said connecting means.

8. The apparatus as set forth in claim 6 wherein said connecting means includes biasing means for biasing said piston against said diaphragm.

9. The apparatus as set forth in claim 5 wherein said body includes a pair of opposed radially extending passageways communicating between said opening and the periphery of said body.

10. The orifice assembly as set forth in claim 5 wherein said pair of orifice means are provided with a T-shaped slot adapted for removably securing said orifice means to said adjusting means.

11. The orifice assembly as set forth in claim 5 wherein said pair of orifice means are arranged in opposed relationship within said opening for defining said orifice therebetween.

12. A system for homogenizing a liquid fuel component and water within a conduit having upstream and downstream sides, said apparatus comprising a body positioned within a stream of said liquid fuel component between said upstream and downstream sides for restricting the flow thereof, said body having an opening and a pair of radially extending passageways in communication with said opening, a pair of elements movably positioned in opposed spaced-apart relationship within said opening for providing an orifice therebetween through which said stream of said liquid fuel component flows for homogenizing said liquid fuel component and said water, a rod positioned within one of said radially extending passageways and having one of said elements secured to one end thereof within said opening for controlling the movement of said one element within said opening, and adjusting means connected to the other of said elements for automatically controlling the downstream pressure of the homogenized liquid fuel component and water, said adjusting means comprises a casing having a bore therein, a diaphragm arranged within said casing and dividing said bore into a first and second chamber, said first chamber being in communication with said downstream pressure for causing displacement of said diaphragm, a piston arranged within said second chamber for movement in response to the displacement of said diaphragm, connecting means for connecting said piston to said other of said elements for continuously adjusting the size of said orifice by continuously varying the spaced-apart relationship of said elements with one another within said opening for controlling the pressure of the homogenized liquid fuel component and water within the downstream side of said conduit in response to downstream pressure changes thereof, and sealing means for sealing said piston in sliding engagement within said second chamber so as to prevent fluid communication between said first chamber and said connecting means.

13. The system as set forth in claim 12 wherein said casing includes an opposed upper and lower half providing said bore therebetween.

14. The system as set forth in claim 13 wherein said sealing means includes a plurality of rings arranged circumferentially around said piston.

15. The system as set forth in claim 14 wherein said sealing means further includes an O-ring arranged within said lower half of said casing on a surface thereof opposite a sealing surface of said piston.

16. The system as set forth in claim 13 wherein the periphery of said diaphragm is secured to said casing between said upper and lower halves thereof.

17. The system as set forth in claim 14 wherein said first chamber is in fluid communication with the homogenized liquid fuel component and water.

18. The system as set forth in claim 12 wherein said connecting means includes spring biasing means for biasing said piston against said diaphragm.

* * * * *

UNITED STATES PATENT AND TRADEMARK OFFICE

CERTIFICATE OF CORRECTION

PATENT NO. : 4,493,558

DATED : January 15, 1985

INVENTOR(S) : Dannie B. Hudson

It is certified that error appears in the above-identified patent and that said Letters Patent are hereby corrected as shown below:

Column 5, line 67, change "54" to --154--.

Column 6, line 41, change "22" to --122--.

Column 7, line 21, change "68" to --168--.

Column 7, line 37, change "10" to --110--.

Column 8, line 48, change "vale" to --valve--.

Column 9, line 45, after "upstream" insert --and downstream--.

Signed and Sealed this

*Seventh* Day of *May 1985*

[SEAL]

*Attest:*

DONALD J. QUIGG

*Attesting Officer* *Acting Commissioner of Patents and Trademarks*